US008172220B2

(12) United States Patent
Foster et al.

(10) Patent No.: US 8,172,220 B2
(45) Date of Patent: May 8, 2012

(54) DUAL SHAFT MEDIA PICKING MECHANISM

(75) Inventors: Larry Steven Foster, Lexington, KY (US); David Erwin Rennick, Georgetown, KY (US); Niko J. Murrell, Lexington, KY (US); Jason Lee Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 317 days.

(21) Appl. No.: 12/651,196

(22) Filed: Dec. 31, 2009

(65) Prior Publication Data

US 2011/0156343 A1 Jun. 30, 2011

(51) Int. Cl.
*B65H 3/06* (2006.01)

(52) U.S. Cl. ..... 271/117; 271/109

(58) Field of Classification Search ..... 271/117, 271/118

See application file for complete search history.

(56) References Cited

U.S. PATENT DOCUMENTS 1,244,512 A * 10/1917 Ledbetter ..... 74/423
6,318,715 B1 * 11/2001 Froechte et al. ..... 271/117
7,731,176 B2 * 6/2010 Bato-on et al. ..... 271/117

FOREIGN PATENT DOCUMENTS

JP 55089156 A * 7/1980

* cited by examiner

*Primary Examiner* — Gerald McClain
(74) *Attorney, Agent, or Firm* — John Victor Pezdek

(57) ABSTRACT

A media picking mechanism includes a pair of transmission shafts rotating in opposite directions. A housing is mounted around the pair of transmission shafts such that the first transmission shaft and the second transmission shaft are positioned substantially equidistant from a centerline of the housing. During a media picking operation, the rotation of the first transmission shaft of the pair of transmission shafts provides a first moment to the housing and rotation of a second transmission shaft of the pair of transmission shafts provides a second moment to the housing, which is equal and opposite to the first moment such that a net moment on the housing is near zero minimizing twisting of the housing. The two transmission shafts rotating in opposite directions, also results in substantially equal normal force to be applied by the first and second pick tires on the media.

13 Claims, 3 Drawing Sheets

DUAL SHAFT MEDIA PICKING MECHANISM

BACKGROUND

1. Field of the Invention

The present invention relates generally to an imaging apparatus, and more particularly, to a media picking mechanism in an imaging apparatus.

2. Description of the Related Art

An imaging apparatus, such as a printer, scanner, or copier, includes a media picking mechanism that is used to successively pick a single sheet of media, e.g., paper from a media stack.

FIG. 1 is a perspective view of a media picking mechanism 10 according to a prior art system. The media picking mechanism 10 includes a drive shaft 12, a transmission shaft 14, and a pick shaft 16. A pivot gear 18 is mounted on the drive shaft 12. A first bevel gear 20*a* and a second bevel gear 20*b* are mounted on each end of the transmission shaft 14. The first bevel gear 20*a* is rotatably engaged with the pivot gear 18.

A pick gear 22 is mounted on the pick shaft 16. The pick gear 22 is rotatably engaged with the second bevel gear 20*b*. A first pick tire 24*a* and a second pick tire 24*b* are attached to each end of the pick shaft 16.

The media picking mechanism 10 also includes a housing 26 that contains the pivot gear 18, the first bevel gear 20*a*, the second bevel gear 20*b*, the transmission shaft 14, and the pick gear 22.

During a media picking operation, the drive shaft 12 rotates in a first direction as illustrated by the arrow 28 to provide input torque to the transmission shaft 14. The input torque rotates the transmission shaft 14 in a second direction as illustrated by the arrow 30. The transmission shaft 14 transmits the input torque to the pick shaft 16 that rotates in a third direction as illustrated by the arrow 32.

FIG. 2 is a partial perspective view of the media picking mechanism 10 illustrating forces being applied during a media picking operation. The transmission shaft 14 rotating in the second direction as illustrated by the arrow 30 applies a downward normal force $F_g$ on the pick gear 22. The vertical component of downward force $F_g$ is approximately equal to the sum of a first normal force $F_{N1}$ and a second normal force $F_{N2}$ shown at pick tires 24*a*, 24*b*, respectively.

As shown, force $F_g$ applies a moment $M_h$ on the housing 26 causing the portion of the housing 26 adjacent the second bevel gear 20*b* to twist in a direction of arrow 30. The moment $M_h$ also causes the downward normal force $F_{N1}$ applied to the first pick tire 24*a* towards the media 34 to be greater than the downward normal force $F_{N2}$ applied to the second pick tire 24*b* towards the media 34. The uneven forces $F_{N1}$ and $F_{N2}$ applied on the media 34 causes the media 34 to skew during the media picking operation, and premature wear of the first pick tire 24*a*.

Additionally, another drawback of the prior art media picking mechanism 10 is that the diameter of the pivot gear 18 increases the height of the media picking mechanism 10. The desired architecture of the media picking mechanism 10 requires that the overall height of the media picking mechanism 10 be minimized. The limiting factor for keeping the height of the media picking mechanism 10 to a minimum is the diameter of the pivot gear 18, i.e., pivot gear 18 of a smaller diameter is desired to keep the height of the media picking mechanism 10 to a minimum. However, a reduced diameter of the pivot gear 18 that is too small have been found to cause the pivot gear 18 to either break or to skip teeth when transmitting the input torque to the first bevel gear 20*a* during a media picking operation.

Therefore, it would be advantageous to have a media picking mechanism that provides substantially equal normal forces $F_{N1}$ and $F_{N2}$ to the pick tires 24*a* and 24*b*, has a near zero moment on the housing 26, and also addresses the load carrying limitation of the pivot gear 18.

SUMMARY OF THE INVENTION

Disclosed herein is a media picking mechanism that includes a drive shaft, a pick shaft having a first end and a second end, a first pick tire and a second pick tire, the first pick tire attached to the first end of the pick shaft and the second pick tire attached to the second end of the pick shaft, and a first transmission shaft and a second transmission shaft, each transmission shaft having a first end and a second end, the first end of each transmission shaft operably connected to the drive shaft and the second end of each transmission shaft operably connected to the pick shaft, and the first transmission shaft and the second transmission shaft rotatable in opposite directions relative to one another.

In some embodiments, the media picking mechanism includes a housing mounted around the drive shaft, the pick shaft, and the first transmission shaft and the second with the first and second transmission shafts positioned approximately symmetrically about a centerline of the housing.

In another embodiment, the media picking mechanism includes a first pivot gear and a second pivot gear mounted on the drive shaft, and a gear mounted on the first end of each transmission shaft, the first pivot gear rotatably engaged with the gear mounted on the first transmission shaft and the second pivot gear rotatably engaged with the gear mounted on the second transmission shaft.

In another aspect, a media pick assembly includes a media input tray for storing a media, and a media picking mechanism disposed adjacent the media input tray, the media picking mechanism including a drive shaft, a pick shaft having a first end and a second end, a first pick tire and a second pick tire, the first pick tire attached to the first end of the pick shaft and the second pick tire attached to the second end of the pick shaft, the first pick tire and the second pick tire engaging the media, and a first transmission shaft and a second transmission shaft, each transmission shaft having a first end and a second end, the first end of each transmission shaft operably connected to the drive shaft and the second end of each transmission shaft operably connected to the pick shaft, and the first transmission shaft and the second transmission shaft rotatable in opposite directions relative to one another.

BRIEF DESCRIPTION OF THE DRAWINGS

The above-mentioned and other features and advantages of the various embodiments of the invention, and the manner of attaining them, will become more apparent will be better understood by reference to the accompanying drawings, wherein:

Reference will now be made in detail to the exemplary embodiment(s) of the invention as illustrated in the accompanying drawings. Whenever possible, the same reference numerals will be used throughout the drawings to refer to the same or like parts.

FIG. 3 is a perspective view of a media picking mechanism 40 according to the present invention. The media picking mechanism 40 includes a drive shaft 42 capable of rotating in a first direction as illustrated by arrow 44. Drive shaft 42 is driven by motive force provided by a motor and or gear train (not shown) provided in an apparatus such as an electrophotographic or inkjet imaging device. A first pivot gear 46*a* and a second pivot gear 46*b* are mounted on the drive shaft 42. The first pivot gear 46*a* and the second pivot gear 46*b* are rotatably driven by the drive shaft 42.

Figure 1:
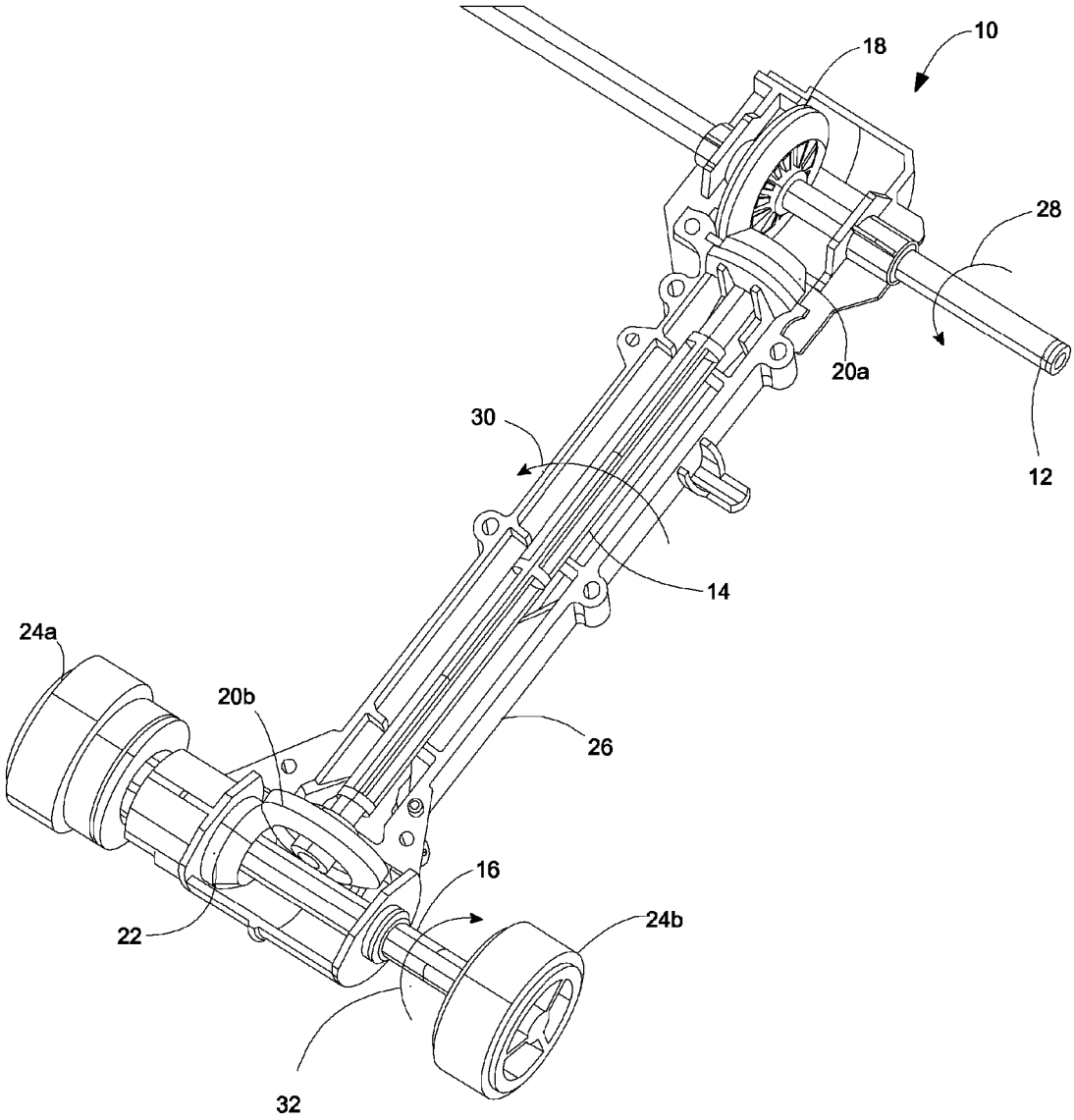
FIG. 1 Prior Art
FIG. 1 is a perspective view of a media picking mechanism according to a prior art system.
Figure 2:
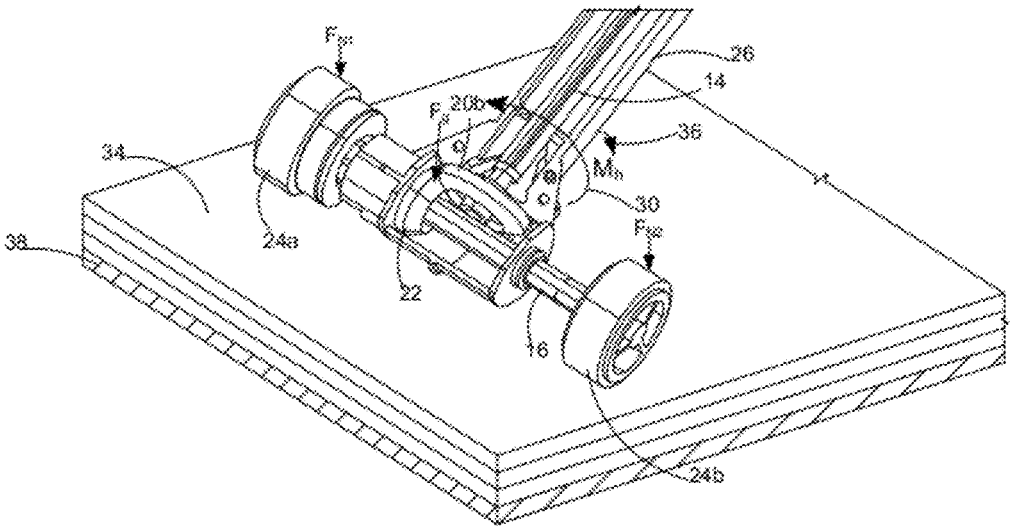
FIG. 2 Prior Art
FIG. 2 is a partial sectional view of the picking mechanism of FIG. 1 illustrating the forces being applied to the media picking mechanism during a media picking operation.

The media picking mechanism 40 include a first transmission shaft 48*a* and a second transmission shaft 48*b*. The transmission shafts 48*a* and 48*b* have a first end 50*a* and 50*b*, respectively, and a second end 52*a* and 52*b*, respectively. A gear 54*a* is mounted on the first end 50*a* of the first transmission shaft 48*a* and engages the first pivot gear 46*a*. A gear 54*b* is mounted on the first end 50*b* of the second transmission shaft 48*b* and engages the second pivot gear 46*b*. A gear 56*a* is mounted on the second end 52*a* of the first transmission shaft 48*a*. A gear 56*b* is mounted on the second end 52*b* of the second transmission shaft 48*b*. The gears 54*a*, 54*b*, 56*a*, and 56*b* are bevel gears, but other configurations as known to those of skill in the art may be used and still fall within the scope of the present invention.

The media picking mechanism 40 further includes a pick shaft 58. The pick shaft 58 has a first end 60 and a second end 62. A first pick gear 64*a* and a second pick gear 64*b*, illustrated as bevel gears, are mounted on the pick shaft 58 and engage gears 56*a* and 56*b*, respectively. A first pick tire 66*a* is attached to the first end 60 of the pick shaft 58, and a second pick tire 66*b* is attached to the second end 62 of the pick shaft 58.

A housing 68 is mounted around drive shaft 42, the first transmission shaft 48*a* and the second transmission shaft 48*b* and extends to and around pick shaft 58. The housing 68 contains the pivot gears 46*a* and 46*b*, the transmission shafts 48*a* and 48*b*, gears 54*a*, 54*b*, 56*a* and 56*b*, the pick gears 64*a* and 64*b*, and the pick shaft 58. As shown pick tires 66*a*, 66*b* are mounted on the ends 60, 62, respectively, of pick shaft 58 outside of housing 68. The first transmission shaft 48*a* and the second transmission shaft 48*b* are positioned approximately symmetrically about a centerline 69 of the housing 68 extending generally from pivots gears 46*a*, 46*b* to pick gears 64*a*, 64*b* and substantially parallel to the centerline 69 of the housing 68.

During a media picking operation, the drive shaft 42 rotating in the direction of arrow 44 provides torque to the first transmission shaft 48*a* and the second transmission shaft 48*b*. The pivot gears 46*a* and 46*b* rotatably engaged with the gears 54*a* and 54*b* transmit torque to the transmission shafts 48*a* and 48*b*. Torque provided by the drive shaft 42 rotates the first transmission shaft 48*a* in a first direction of arrow 70 and the second transmission shaft 48*b* in a second direction of arrow 72, opposite to the first direction of arrow 70. The first transmission shaft 48*a* and the second transmission shaft 48*b* rotate at same speed. The first direction of arrow 70 is a clockwise direction and the second direction of arrow 72 is a counter-clockwise direction, or vice versa.

By virtue of the symmetry of the components, the first transmission shaft 48*a* transmits approximately 50 percent of torque to the first pick tire 66*a*, and the second transmission shaft 48*b* transmits approximately 50 percent of torque to the second pick tire 66*b*. The distribution of torque between the first transmission shaft 48*a* and the second transmission shaft 48*b* enables a greater amount of torque to be transmitted through the media picking mechanism 40 compared to the single transmission shaft 14 of the prior art media picking mechanism 10 shown in FIG. 1 for comparable gear designs.

Figure 4:
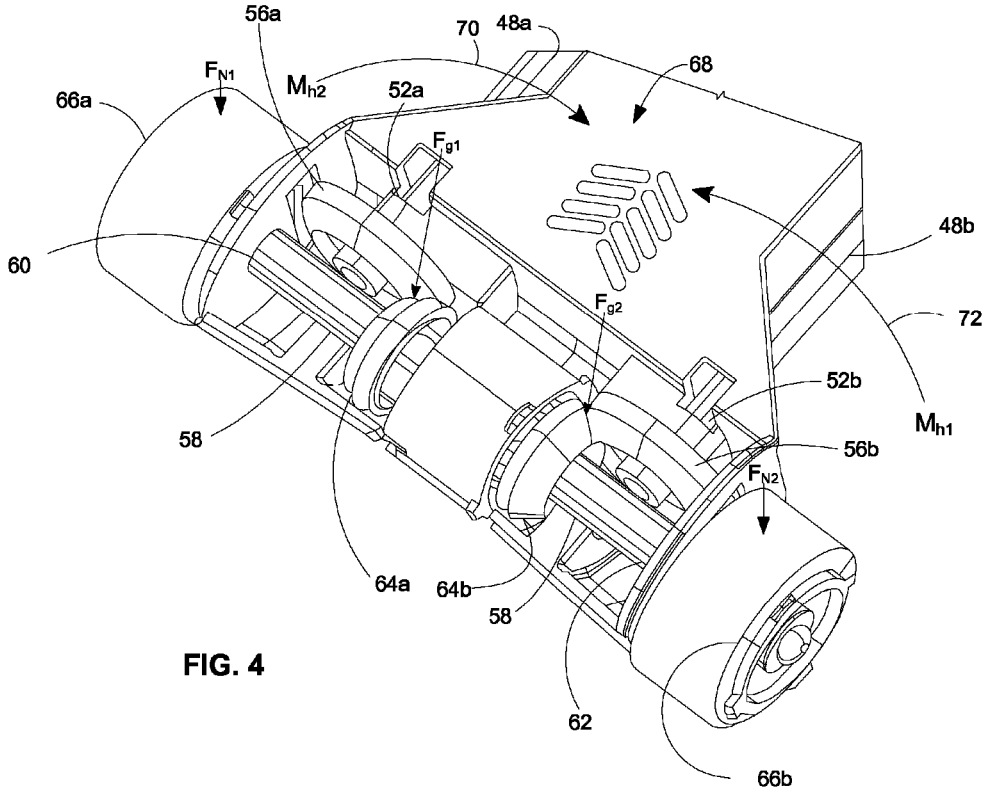
FIG. 4 is a partial sectional view of the media picking mechanism of FIG. 3 illustrating the forces being applied to the media picking mechanism during a media picking operation.

FIG. 4 illustrates forces acting on the media picking mechanism 40 during the media picking operation. The first transmission shaft 48*a* rotating in the first direction of arrow 70 applies a force $F_{g1}$ on the first pick gear 64*a*. The second transmission shaft 48*b* rotating in the second direction of arrow 72 applies a force $F_{g2}$ on the second pick gear 64*b*. The force $F_{g1}$ and the force $F_{g2}$ are applied in the same direction (normal to the face of the gear tooth) and are of approximately the same magnitude.

As shown, the force $F_{g1}$ imposes a moment $M_{h1}$ on the housing 68 and the force $F_{g2}$ imposes a moment $M_{h2}$ on the housing 68 in opposite direction. Due to the approximate symmetric placement of the first transmission shaft 48*a* and the second transmission shaft 48*b* about the centerline of the housing 68, the two moments $M_{h1}$ and $M_{h2}$, which are acting in opposite directions, cancel each other and result in a substantially zero net moment on the housing 68. The near zero net moment acting on the housing 68 ensures that there is substantially no twisting of the housing 68. Thus, the two transmission shafts 48*a* and 48*b* rotating in opposite directions resolves the problem of twisting of the housing 68 encountered in prior art systems.

Figure 3:
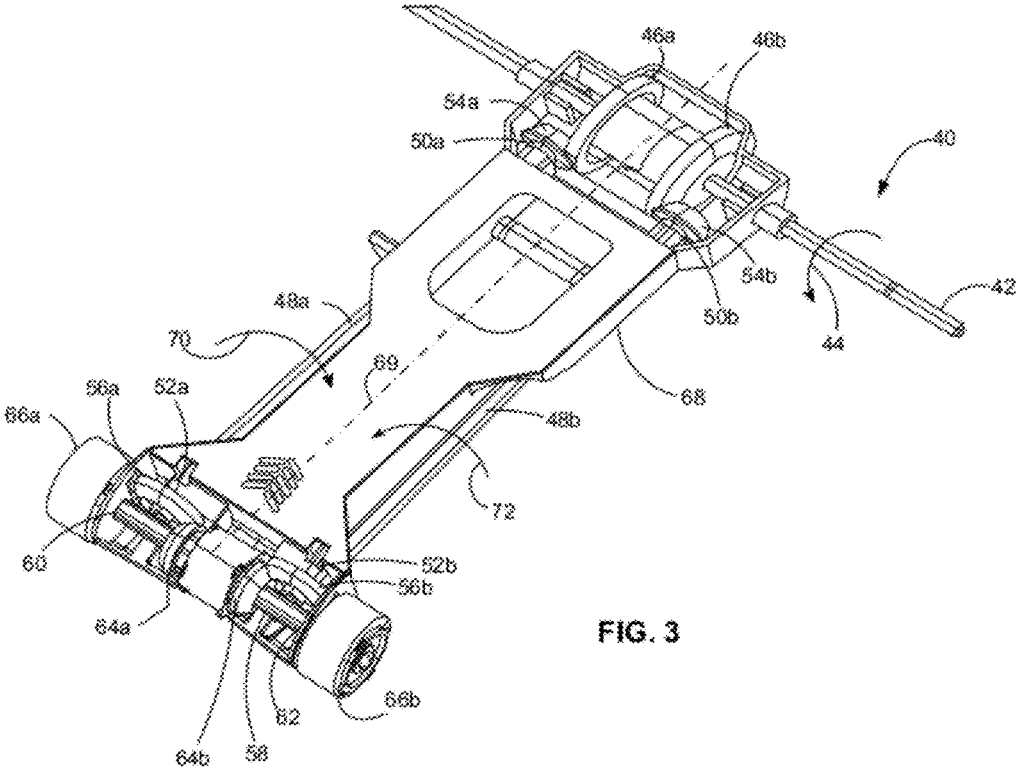
FIG. 3 is a perspective view of one embodiment of a media picking mechanism according to the present invention.
Figure 5:
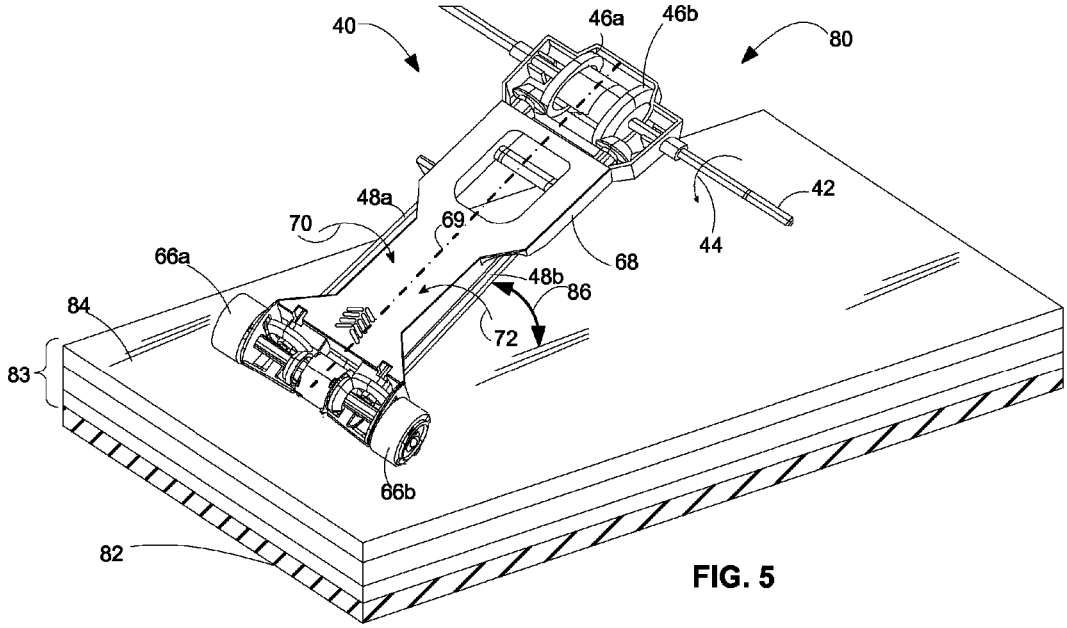
FIG. 5 is a perspective view of the media picking mechanism of FIG. 3 in a media tray.

FIG. 5 is a perspective view of the media picking mechanism 40 of FIG. 3 in a media tray forming a media pick assembly 80. The media pick assembly 80 includes a media input tray 82 for storing a stack of media 83. The media picking mechanism 40 is disposed adjacent the media input tray 82. During media picking, the first pick tire 66*a* and the second pick tire 66*b* engage the top-most media sheet 84 of the media stack 83 in the media input tray 82. When the media tray is to be removed, the drive shaft 42 of media picking mechanism 40 can be rotated in the opposite direction to lift it away from the media stack 83.

During a media picking operation, the drive shaft 42 rotates in the direction of arrow 44 to provide torque to the first transmission shaft 48*a* and the second transmission shaft 48*b*. The torque rotates the first transmission shaft 48*a* in the first direction of arrow 70 and the second transmission shaft 48*b* in the second direction of arrow 72, opposite to the first direction of arrow 70.

The torque creates a first downward normal force $F_{N1}$ on the first pick tire 66*a* towards the media 84 and a second downward normal force $F_{N2}$ on the second pick tire 66*b* towards the media 84. As discussed above, the first transmission shaft 48*a* and the second transmission shaft 48*b* rotate in opposite directions, which results in a zero net moment on the housing 68. The near zero net moment acting on the housing 68 ensures that the first downward normal force $F_{N1}$ acting on the first pick tire 66*a* towards the media 84 is approximately the same as the second downward normal force $F_{N2}$ acting on the second pick tire 66*b* towards the media 84. This allows the first pick tire 66*a* and the second pick tire 66*b* to contact the media 84 with substantially the same force, thus reducing media skew during the media picking operation.

The present invention also alleviates the problem of height of the media picking mechanism 40, due to the constraint on the diameter of the pivot gear 18 (see FIG. 1) in the prior art system. The present invention provides two pivot gears 46*a* and 46*b* mounted on the drive shaft 42. The diameters of the pivot gears 46*a* and 46*b* are one half of the diameter of the pivot gear 18, while maintaining the same stress level as that of pivot gear 18.

Further, as the torque is distributed between two pivot gears 46*a* and 46*b*, torque required to rotate longer transmission shafts 48*a* and 48*b* is provided. As the media picking mechanism 40 has longer transmission shafts 48*a* and 48*b*, than those of the prior art system the change between an angle illustrated by doubled headed arrow 86 formed between the media picking mechanism 40 and the surface of media 84 when the media tray 82 is full with media 84 and when the media tray 82 has little media 84 is reduced significantly, compared to the prior art system.

Due to this reduction in change of the angle illustrated by double headed arrow 86, during the media picking operation, the normal forces $F_{N1}$, and $F_{N2}$ applied to the pick tires 66*a* and 66*b* towards the media 84 when the media tray 84 is full with media 82 are similar to the normal forces $F_{N1}$, and $F_{N2}$ applied to the pick tires 66*a* and 66*b* towards the media 84, when the media tray 82 has little media 84. Thus, the pick performance of the media picking mechanism 40 is considerably improved compared to the prior art system.

The maximum capacity of the media tray determines the maximum height of the media stack and the minimum height of the media stack occurs when there is one media sheet left in the stack. With both the prior art picking mechanism 10 and picking mechanism 40, the normal force increases as the media stack height decreases. The twin transmission picking mechanism 40 has a greater efficiency than the previous single transmission mechanism (assuming gear losses are comparable) because the load is shared and efficiency losses due to angular displacements in the shaft are reduced. The twin transmission shafts provide a more torsionally rigid structure than the prior art picking mechanism 10. Because of the increased torsional rigidity longer transmission shafts can be used than was possible with the prior art picking mechanism 10, assuming that for both mechanisms, the transmission shafts were made of the same materials. Longer transmission shafts allow the angle between the picking mechanism and the surface of the media over the range of maximum capacity to minimum capacity of a media tray to be shallower than can be obtained with a single transmission shift. This in turn means that the change in normal force directed to the pick tires is less and thus the normal force applied to the media is more consistent as the media sheets are picked from the media tray and the media stack height decreases. Thus a better pick performance is achieved over the range of stack height with a given media tray design with media picking mechanism 40 than compared to prior art picking mechanism 10.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A media picking mechanism comprising:

a drive shaft;

a pick shaft having a first end and a second end;

a first pick tire and a second pick tire, the first pick tire directly attached to the first end of the pick shaft and the second pick tire directly attached to the second end of the pick shaft; and a first transmission shaft and a second transmission shaft, each transmission shaft having a first end and a second end, the first end of each transmission shaft operably connected to the drive shaft and the second end of each transmission shaft operably connected to the pick shaft, and the first transmission shaft and the second transmission shaft rotatable in opposite directions relative to one another;

wherein an axis of the pick shaft is parallel to an axis of the drive shaft.

2. The media picking mechanism of claim 1, further comprising:

a housing mounted around the drive shaft, pick shaft, the first transmission shaft and the second transmission shaft, the first transmission shaft and the second transmission shaft positioned approximately symmetrically about a centerline of the housing.

3. The media picking mechanism of claim 1, further comprising:

a first pivot gear and a second pivot gear mounted on the drive shaft; and a gear mounted on the first end of each transmission shaft, the first pivot gear rotatably engaged with the gear mounted on the first transmission shaft and the second pivot gear rotatably engaged with the gear mounted on the second transmission shaft.

4. The media picking mechanism of claim 1, wherein the drive shaft transmits torque to the first transmission shaft and the second transmission shaft, the first transmission shaft transmits approximately 50 percent of torque to the first pick tire and the second transmission shaft transmits approximately 50 percent of torque to the second pick tire.

5. The media picking mechanism of claim 1, wherein the first transmission shaft and the second transmission shaft are rotating at a same speed.

6. The media picking mechanism of claim 1, wherein the first transmission shaft rotates in a clockwise direction and the second transmission shaft rotates in a counter-clockwise direction.

7. The media picking mechanism of claim 1, wherein the first transmission shaft rotates in a counter-clockwise direction and the second transmission shaft rotates in a clockwise direction.

8. A media pick assembly, comprising:

a media input tray for storing a stack of media sheets; and a media picking mechanism disposed adjacent the media input tray, the media picking mechanism comprising:

a drive shaft to be rotatably driven;

a pick shaft having a first end and a second end;

a first pick tire and a second pick tire, the first pick tire directly attached to the first end of the pick shaft and the second pick tire directly attached to the second end of the pick shaft, the first pick tire and the second pick tire engaging the top-most media sheet; and a first transmission shaft and a second transmission shaft, each transmission shaft having a first end and a second end, the first end of each transmission shaft operably connected to the drive shaft and the second end of each transmission shaft operably connected to the pick shaft, and the first transmission shaft and the second transmission shaft rotatable in opposite directions relative to one another when the drive shaft is rotated;

wherein an axis of the pick shaft is parallel to an axis of the drive shaft.

9. The media pick assembly of claim 8, wherein the media picking mechanism further comprises:

a housing mounted around the drive shaft, the pick shaft, the first transmission shaft and the second transmission shaft, the first transmission shaft and the second transmission shaft positioned approximately symmetrically about a centerline of the housing.

10. The media pick assembly of claim 8, wherein the media picking mechanism further comprises:

a first pivot gear and a second pivot gear mounted on the drive shaft; and a gear mounted on the first end of each transmission shaft, the first pivot gear rotatably engaged with the gear mounted on the first transmission shaft and the second pivot gear rotatably engaged with the gear mounted on the second transmission shaft.

11. The media picking assembly of claim 8, wherein the first transmission shaft and the second transmission shaft are rotating at a same speed.

12. The media pick assembly of claim 8, wherein the first transmission shaft and the second transmission shaft rotating in opposite directions apply an approximately equal force on the first pick tire and the second pick tire towards the media.

13. A media picking mechanism, comprising:

a rotatable drive shaft having a first bevel gear and a second bevel gear mounted thereon;

a pick shaft having a first end and a second end with a first and second bevel gear mounted between the first end and the second end of the pick shaft;

a first pick tire and a second pick tire, the first pick tire directly attached to the first end of the pick shaft and the second pick tire directly attached to the second end of the pick shaft;

a first transmission shaft and a second transmission shaft, each transmission shaft having a first end and a second end, each of the respective first and second ends of the transmission shafts having a bevel gear mounted thereon, the bevel gear on the first end of the first transmission shaft rotatably connected to the first bevel gear on the drive shaft and the bevel gear on the second end of the first transmission shaft rotatably connected to the first bevel gear on the pick shaft, the bevel gear on the first end of the second transmission shaft rotatably connected to the second bevel gear on the drive shaft and the bevel gear on the second end of the second transmission shaft rotatably connected to the second bevel gear on the pick shaft, the first transmission shaft and the second transmission shaft rotatable in opposite directions relative to one another when the drive shaft is rotated; and a housing mounted around the drive shaft, the first transmission shaft, the second transmission shaft and the pick shaft with the first and second transmission shafts positioned substantially symmetrically about a centerline of the housing, wherein the drive shaft transmits torque to the first transmission shaft and the second transmission shaft, the first transmission shaft transmits approximately 50 percent of torque to the first pick tire and the second transmission shaft transmits approximately 50 percent of torque to the second pick tire and a force from the first transmission shaft applied to the first bevel gear mounted on the pick shaft produces a moment having a direction opposite to a second moment produced by a second force from the second transmission shaft applied to the second bevel gear mounted on the pick shaft with the magnitudes of the first and second moments being substantially equal.

* * * * *